US008938865B2

(12) United States Patent
Novara

(10) Patent No.: US 8,938,865 B2
(45) Date of Patent: Jan. 27, 2015

(54) BUCKLE FOR RESTRAINT BELTS, PARTICULARLY FOR CAR SAFETY SEATS FOR CHILDREN

(71) Applicant: Novarace S.r.l., Turin (IT)

(72) Inventor: Paolo Novara, Turin (IT)

(73) Assignee: Novarace S.r.l., Turin (IT)

( * ) Notice: Subject to any disclaimer, the term of this patent is extended or adjusted under 35 U.S.C. 154(b) by 0 days.

(21) Appl. No.: 13/706,037

(22) Filed: Dec. 5, 2012

(65) Prior Publication Data

US 2013/0160253 A1 Jun. 27, 2013

(30) Foreign Application Priority Data

Dec. 7, 2011 (IT) ..... TO2011A1122

(51) Int. Cl.
*A44B 11/25* (2006.01)

(52) U.S. Cl.
CPC ..... *A44B 11/2523* (2013.01)
USPC ..... 24/642; 24/633; 24/634

(58) Field of Classification Search
USPC ..... 24/633, 634, 642
See application file for complete search history.

(56) References Cited

U.S. PATENT DOCUMENTS

| | | | | | |
|---|---|---|---|---|---|
| 5,038,446 | A * | 8/1991 | Anthony et al. | ..... | 24/579.11 |
| 5,142,748 | A * | 9/1992 | Anthony et al. | ..... | 24/579.11 |
| 5,182,837 | A * | 2/1993 | Anthony et al. | ..... | 24/642 |
| 5,220,713 | A * | 6/1993 | Lane et al. | ..... | 24/628 |
| 5,526,556 | A * | 6/1996 | Czank | ..... | 24/637 |
| 5,588,189 | A * | 12/1996 | Gorman et al. | ..... | 24/632 |
| 5,606,783 | A * | 3/1997 | Gillis et al. | ..... | 24/632 |
| 5,813,097 | A * | 9/1998 | Woellert et al. | ..... | 24/631 |
| 6,606,770 | B1 * | 8/2003 | Badrenas Buscart | ..... | 24/625 |
| 6,868,591 | B2 * | 3/2005 | Dingman et al. | ..... | 24/615 |
| 7,263,750 | B2 * | 9/2007 | Keene et al. | ..... | 24/638 |
| 7,698,791 | B2 * | 4/2010 | Pezza | ..... | 24/579.11 |
| 2004/0003486 | A1 * | 1/2004 | Dingman et al. | ..... | 24/177 |

(Continued)

FOREIGN PATENT DOCUMENTS

| | | |
|---|---|---|
| EP | 2 236 351 A | 10/2010 |
| WO | WO 2010/085305 A2 | 7/2010 |

OTHER PUBLICATIONS

Italian Search Report for corresponding Italian Patent Application No. TO2011A001122 mailed Jul. 30, 2012.

(Continued)

*Primary Examiner* — Robert J Sandy
*Assistant Examiner* — David Upchurch
(74) *Attorney, Agent, or Firm* — Merchant & Gould P.C.

(57) ABSTRACT

A buckle includes a snap coupling mechanism including a locking element pivotable between a locked and an unlocked position for engaging and disengaging two tongues, respectively; a release button movable between a raised position and a lowered position corresponding to the locked and unlocked positions, respectively; a spring tending to keep the release button in the raised position; and two sliders opposing the insertion of the tongues. The sliders are configured to come between a body of the buckle and the locking element, when the locking element is moved into the unlocked position, so as to prevent the locking element from moving from the unlocked position to the locked position. The release button is connected to the locking element so that when the release button is pressed, the locking element moves into the unlocked position, whereas when the release button is released, the locking element moves into the locked position.

7 Claims, 5 Drawing Sheets

(56) References Cited

U.S. PATENT DOCUMENTS

| | | | | |
|---|---|---|---|---|
| 2005/0115035 | A1* | 6/2005 | Karlsson | 24/633 |
| 2007/0050954 | A1* | 3/2007 | Anscher | 24/265 BC |
| 2007/0204442 | A1* | 9/2007 | Falb et al. | 24/633 |
| 2007/0229244 | A1* | 10/2007 | Peeler et al. | 340/457.1 |
| 2007/0283539 | A1* | 12/2007 | Pezza | 24/640 |
| 2008/0163468 | A1* | 7/2008 | Nakamura et al. | 24/641 |
| 2009/0183348 | A1 | 7/2009 | Walton et al. | |
| 2010/0264707 | A1* | 10/2010 | Tang et al. | 297/250.1 |
| 2011/0107560 | A1* | 5/2011 | Buckingham et al. | 24/166 |

OTHER PUBLICATIONS

Extended European Search Report for corresponding European Patent Application No. 12195948.0 mailed Mar. 5, 2013.

* cited by examiner

BUCKLE FOR RESTRAINT BELTS, PARTICULARLY FOR CAR SAFETY SEATS FOR CHILDREN

This application claims benefit of Serial No. TO2011A001122, filed 7 Dec. 2011 in Italy and which application is incorporated herein by reference. To the extent appropriate, a claim of priority is made to each of the above disclosed applications.

BACKGROUND OF THE INVENTION

The present invention relates in general to a fastening device for restraint belts, particularly for car safety seats for children, and more in particular to a buckle for such a fastening device.

The restraint belts used on car safety seats for children typically comprise three branches, which can be releasably connected to each other by means of a fastening device comprising a buckle attached to the free end of one of the branches and two tongue-like coupling elements (hereinafter simply referred to as "tongues"), which are attached to the other two branches and are intended to be inserted into an inner body (preferably made of metal) of the buckle along a direction of insertion and to be locked therein to ensure that the belts are fastened around the trunk of the child sitting in the seat.

More specifically, the present invention relates to a buckle provided with a snap coupling mechanism adapted to releasably couple the two tongues to the inner body, the snap coupling mechanism comprising:

a locking element supported by the inner body so as to be pivotable about an axis perpendicular to the direction of insertion between a lock position, in which it engages the tongues and thus keeps them restrained in the inner body, and an unlock position, in which it disengages the tongues thereby making them free to be ejected from or pulled out of the inner body, a release button which is operatively connected to the locking element and can be moved by the user along a direction perpendicular both to the direction of insertion of the tongues and to the pivot axis of the locking element to cause the locking element to move from the lock position to the unlock position, thereby allowing the tongues to be ejected from the inner body, and a pair of sliders or ejectors mounted in the inner body so as to be movable along respective directions parallel to the direction of insertion of the tongues, the sliders being urged by respective springs in order to apply on the tongues a resilient force tending to oppose the insertion of the tongues into the inner body and to make the ejection of the tongues from the inner body, when the locking element is in the unlock position, easier. In a buckle of the above-specified kind, the release button is normally kept by a spring in a raised rest position, i.e. in a rest position facing outwardly of the buckle. In order to uncouple the tongues from the buckle, the user must press the release button against the resilient force applied by the associated spring. Once released, the release button gets back into its rest position under the action of the associated spring. When the tongues are inserted into the inner body to fasten the restraint belts, the release button remains in the rest position under the action of the associated spring, independently of the tongues having been correctly inserted into the inner body and engaged by the locking element. This is particularly critical for buckles to be sold on the US market, since the regulations currently in force in the United States provide for the possibility to insert one tongue at a time into the buckle. It may therefore happen that a first tongue is correctly inserted into and coupled to the buckle and that the second tongue is inserted into the buckle but is not correctly locked by the locking element without this being immediately and unambiguously realized by the user.

SUMMARY OF THE INVENTION

It is an object of the present invention to provide a buckle of the above-specified kind, which is able to make the user immediately realize whether the tongues are correctly locked therein.

This object is fully achieved according to the present invention by virtue of a buckle for restraint belts, particularly for car safety seats for children.

In short, the invention is based on the idea of providing a buckle of the above-identified kind, wherein each slider is configured to come between the inner body and the locking element, when this latter is moved into the unlock position, so as to prevent the locking element from moving into the lock position until it is urged back, against the resilient action of the respective spring, by the respective tongue when this latter is inserted into the buckle, and wherein the release button and the locking element are connected to each other in such a manner that when the release button is pressed the locking element moves away from the inner body into the unlock position, whereas when the release button is released, and hence gets back into the rest position due to the resilient action applied thereon by the associated spring, the locking element is pulled by the release button so as to move towards the inner body and take the lock position.

By virtue of such a configuration, as long as the tongues are not inserted into the buckle to such an extent as to prevent the sliders from keeping the locking element in the unlock position, the locking element remains in the unlock position and hence the release button, which moves as a single body with the locking element, remains in the pressed or lowered position. The release button has thus two stable operating positions, namely a first position corresponding to the aforesaid rest position (or raised position), that the release button takes when the locking element is in the lock position, and a second position (or lowered position) that the release button takes when the locking element is in the unlock position. Accordingly, as long as the tongues are not correctly inserted into the inner body and engaged by the locking element, the locking element is kept by the slider(s) in the unlock position and hence the release button is kept in the aforesaid second position. The user is therefore in the condition to immediately and unambiguously realize, seeing that the release button is still lowered, that the tongues are not both correctly locked in the buckle.

According to an embodiment of the invention, in order to allow the user to realize in a still more immediate and clear way whether the tongues are correctly locked in the inner body of the buckle, the buckle comprises signalling means associated to the release button to provide the user with a visual indication associated to at least one of the two stable positions of the release button, showing for instance a green-coloured symbol when the release button is in the raised position corresponding to the tongues being correctly locked in the inner body of the buckle.

BRIEF DESCRIPTION OF THE DRAWINGS

Further features and advantages of the present invention will become apparent from the following detailed description, given purely by way of non-limiting example with reference to the appended drawings, in which.

DETAILED DESCRIPTION OF THE PREFERRED EMBODIMENTS

Figure 1:
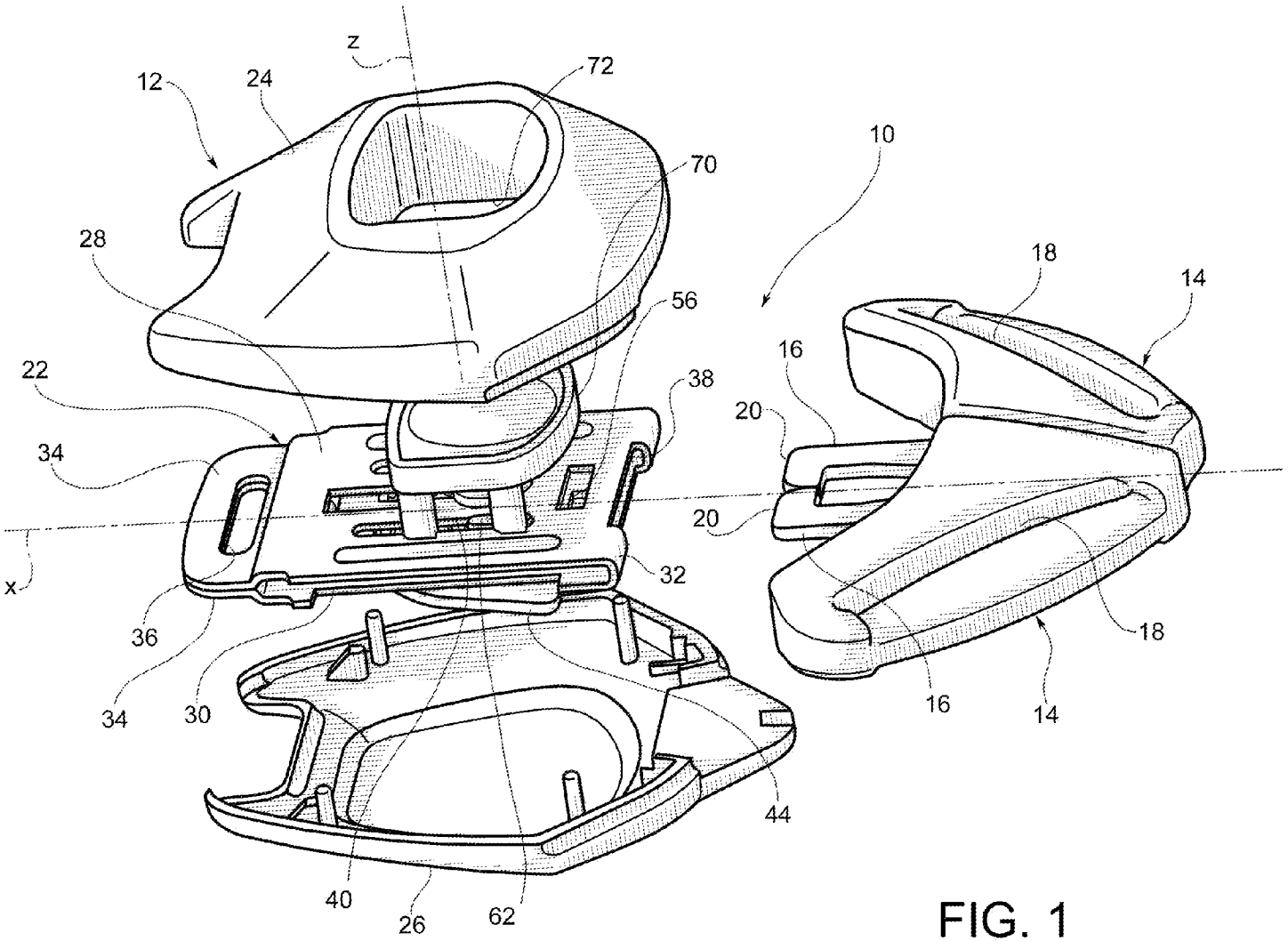
FIGS. 1 and 2 are exploded perspective views, from above and from below, respectively, of a fastening device for three-branch restraint belts, particularly for car safety seats for children, according to a preferred embodiment of the present invention.

In the following description and claims, terms such as "upper" and lower" are to be intended as referring to the orientation of the fastening device as shown in FIG. 1, where the release button of the buckle is visible from above.

Figure 2:
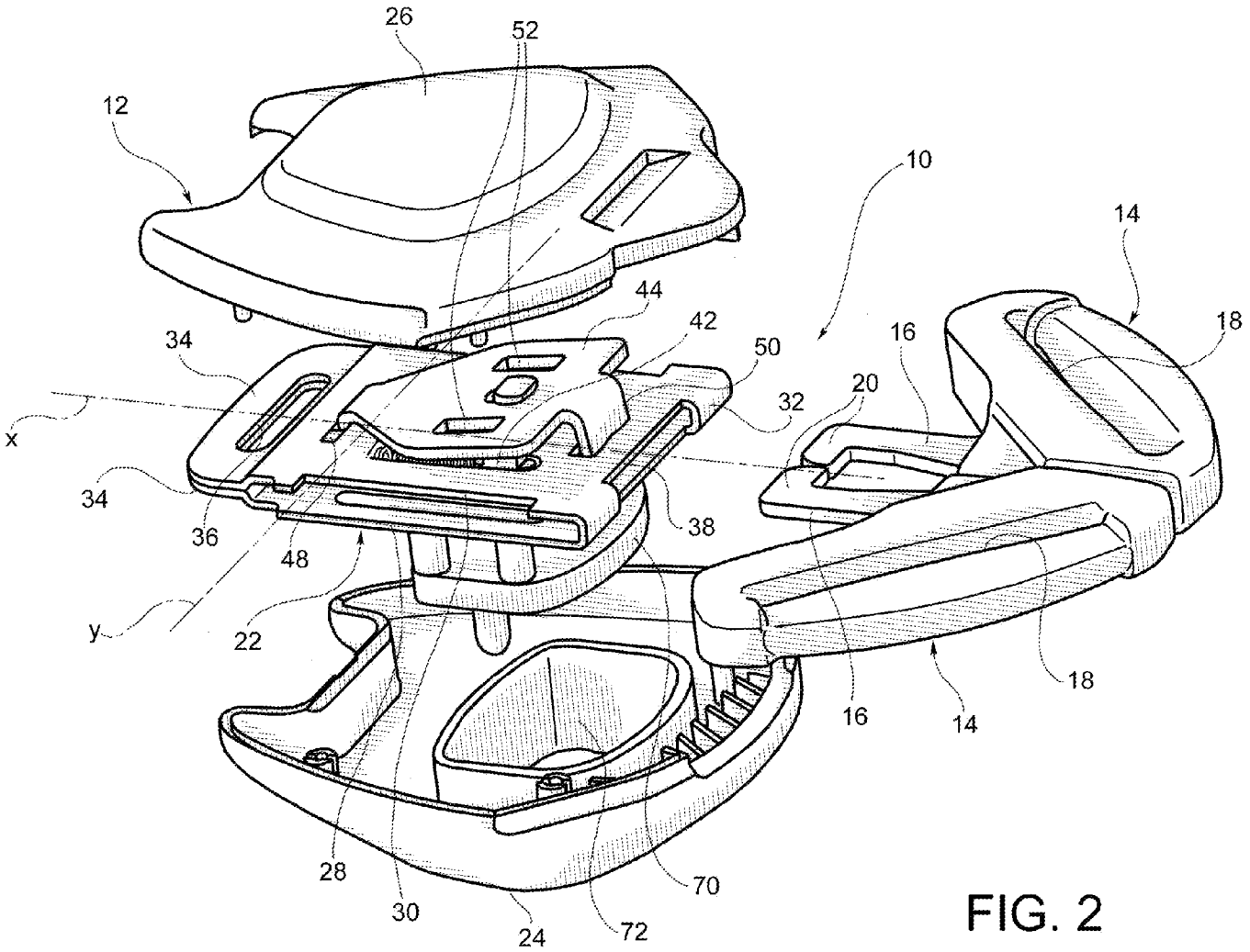
Figure 3:
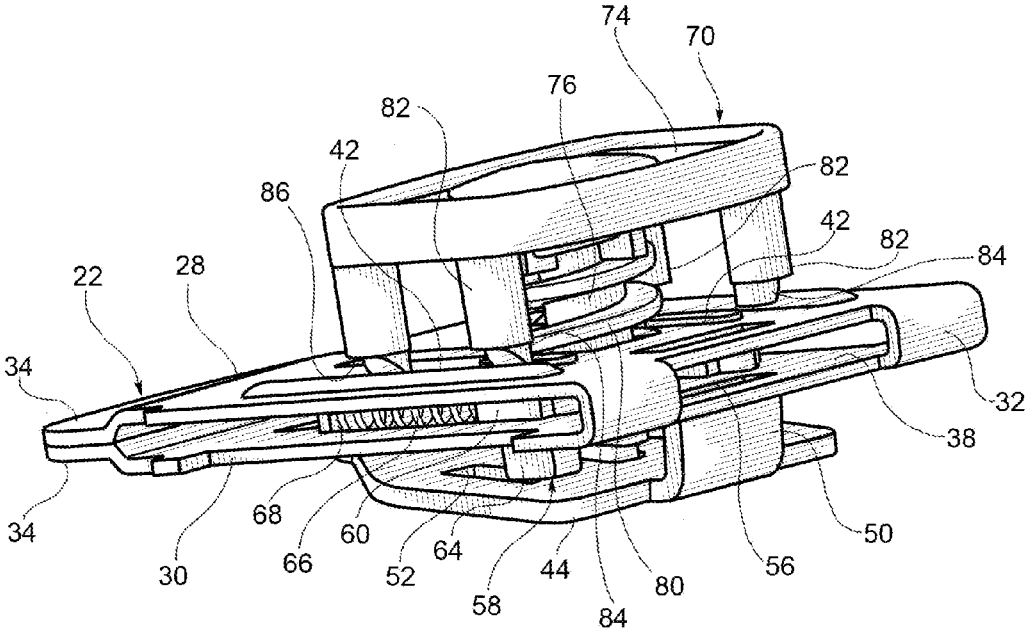
FIGS. 3 and 4 are a perspective view and a side elevational view, respectively, of the snap coupling mechanism and of the inner body of the buckle of the fastening device of FIGS. 1 and 2 in the open position, i.e. in the unlock position of the locking element of that mechanism.

With reference first to FIGS. 1 and 2, a fastening device for three-branch restraint belts, particularly for car safety seats for children, is generally indicated 10 and basically comprises a buckle 12 intended to be attached to the free end of a belt branch (not shown) and a pair of tongue-like elements 14 (hereinafter simply referred to as tongues) intended to be attached each to a respective belt branch (also not shown) and to be inserted into the buckle 12 to be locked therein in order to ensure that the belts are fastened around the trunk of the child sitting in the seat.

Each tongue 14 preferably includes a metal core made for instance as a plate-like element integrally forming a stem portion 16, which is adapted to be inserted into the buckle 12 along a direction of insertion x and locked therein, and an attachment portion (not shown), in which a slot 18 is provided for attachment of the tongue to the respective belt branch. The stem portion 16 of each tongue 14 also forms at its free end a coupling tooth 20, which extends perpendicular to the direction of insertion x. The metal core is fully covered by a layer of plastic material or rubber, which is advantageously obtained by overmoulding of that material over the metal core.

The buckle 12 includes an inner body 22 preferably made as a single piece of sheet metal obtained by blanking and folding and an outer shell preferably consisting in two upper and lower half-shells 24 and 26, respectively, which are firmly connected to each other so as to enclose the inner body 22. The half-shells 24 and 26 are preferably made of plastic material.

According to the illustrated embodiment, the inner body 22 includes an upper plate 28 and a lower plate 30 which extend parallel to and spaced from each other and are connected at a first end by a connecting portion 32 which extends substantially perpendicular to the two plates 28 and 30. The two plates 28 and 30 form at the opposite end respective attachment extensions 34, each having a slot 36 for fixing the inner body 22, and therefore the whole buckle 12, to the respective belt branch. The two plates 28 and 30 are also connected to each other in the zone of the attachment extensions 34, for instance by welding, gluing or riveting. The connecting portion 32 has a through opening 38, through which the stem portions 16 of the tongues 14, along with the respective coupling teeth 20, are inserted into the inner body 22. The upper plate 28 and the lower plate 30 have each a pair of longitudinal slits, indicated 40 and 42, respectively, i.e. a pair of slits which extend parallel to the direction of insertion x. The longitudinal slits 40 of the upper plate 28 are aligned to the longitudinal slits 42 of the lower plate 30 and preferably have the same length as these latter. The buckle 12 further comprises a snap coupling mechanism for releasably connecting the two tongues 14 to the inner body 22.

First of all, the snap coupling mechanism comprises a locking element 44 made as a plate-like element, preferably of metal, in particular of steel. The locking element 44 forms, at its end facing in the assembled condition towards the slot 36 of the inner body 22 (belt-side end), a hinge tab 46 having a goose-neck shape and engaging in a first transverse slit 48 (i.e. a first slit extending perpendicular to the direction of insertion x) of the lower plate 30 of the inner body 22 to allow the locking element 44 to pivot relative to the inner body 22 about a transverse pivot axis y. Moreover, by virtue of the use of a single hinge tab 46 placed in the middle of the locking element 44, this latter can pivot relative to the inner body 22 also about an axis coinciding with the direction of insertion x to allow the insertion of only one tongue at a time into the inner body 22. At the opposite end, i.e. at the end facing in the assembled condition towards the opening 38 (tongue-side end), the locking element 44 forms a stop tab 50 which extends perpendicular to the middle plane of the locking element 44 and has the function of restraining the coupling teeth 20 of the tongues 14 in the direction of insertion x. Preferably, both the hinge tab 46 and the stop tab 50 are formed as a single piece with the locking element 44. The locking element 44 has also a pair of longitudinal slits 52, which in the assembled condition are aligned each to a respective longitudinal slit 40 of the upper plate 28 and to a respective longitudinal slit 42 of the lower plate 30 of the inner body 22. The length of the longitudinal slits 52 of the locking element 44 is smaller than that of the longitudinal slits 42 of the lower plate 30 of the inner body 22. As shown in FIGS. 3 to 6, the locking element 44 is able to pivot relative to the inner body 22 about the aforesaid pivot axis y between a lock position (FIGS. 5 and 6), in which it engages the coupling teeth 20 of the tongues 14, thereby keeping these latter restrained in the inner body 22, and an unlock position (FIGS. 3 and 4), in which it disengages the tongues 14 and hence make them free to be ejected from or pulled out of the inner body 22. In the lock position, the locking element 44 abuts against the outer face of the lower plate 30 of the inner body 22 and the stop tab 50 enters the inner body 22 passing through a second transverse slit 56 provided in the lower plate 30 of the inner body 22. In this position, the stop tab 50 forms an abutment surface which, cooperating with the coupling teeth 20 of the tongues 14, prevents these latter from being released from the buckle 12. In the unlock position, the locking element 44 is inclined to the lower plate 30 about the pivot axis y by an angle such that the stop tab 50 does not enter the inner body 22 and hence does not engage the coupling teeth 20 of the tongues 14. The tongues 14 can thus be released from the buckle 12.

The snap coupling mechanism further comprises a pair of sliders 58 having the function of opposing the insertion of the tongues 14 into the buckle 12 when the belts are fastened and of making the ejection of the tongues 14 from the buckle 12 easier when the belts are unfastened. Each slider 58 comprises a middle portion 60, which is received between the two plates 28 and 30 of the inner body 22 and has a width larger than that of the longitudinal slits 40 and 42 provided in those plates, and a pair of upper and lower guide projections 62 and 64, respectively, which project from opposite sides of the middle portion 60 and slidably engage in the longitudinal slits 40 and 42 provided in the plates 28 and 30 of the inner body 22. The guide projection 64 (lower guide projection) of each slider 58 has a height such that it projects downwards beyond the outer face of the lower plate 30 of the inner body 22 to slidably engage in the respective longitudinal slit 52 of the locking element 44. A respective spring 66 is associated to each slider 58 and is made for instance as a cylindrical helical spring, which rests at one end (tongue-side end) against the slider 58 and at the opposite end (belt-side end) against a respective abutment surface 68 formed for instance by a respective tab which is bent so as to project towards the inside of the inner body 22 from the upper plate 28 or from the lower plate 30. Each spring 66 applies on the respective slider 58 a resilient force which is directed parallel to the direction of insertion x and tends to urge the slider 58 towards the opening 38 of the inner body 22 (i.e. towards the tongues 14). When the tongues 14 are inserted into the buckle 12, the coupling teeth 20 press each on a respective slider 58, thereby causing it to move back and at the same time the respective spring 66 to be compressed. In this phase, therefore, the sliders 58 and the respective springs 66 apply on the tongues 14 a resilient force tending to oppose the insertion of these latter into the buckle 12. On the contrary, during ejection of the tongues 14 the sliders 58 and the respective springs 66 apply on the tongues 14 a resilient force tending to make the ejection of these latter from the buckle 12 easier.

The sliders 58 also have the function of keeping the locking element 44 stably in the above-described unlock position, once this latter has been moved in that position. When the locking element 44 is in the lock position (FIGS. 5 and 6), the guide projection 64 (lower guide projection) of each slider 58 slidably engages in the respective longitudinal slit 52 of the locking element 44. When, on the other hand, the locking element 44 is moved into the unlock position (FIGS. 3 and 4), the guide projection 64 of each slider 58 disengages from the respective longitudinal slit 52 of the locking element 44 and comes into abutment against a "solid" portion of the locking element itself, thereby preventing the locking element from moving towards the lock position. Only when the tongues 14 are inserted into the inner body 22 and cause the sliders 58 to move backwards, thereby bringing the respective guide projections 64 back inside the respective longitudinal slits 52, the locking element 44 can move towards the lock position. The two lock and unlock positions of the locking element 44 are therefore stable operating positions.

Figure 4:
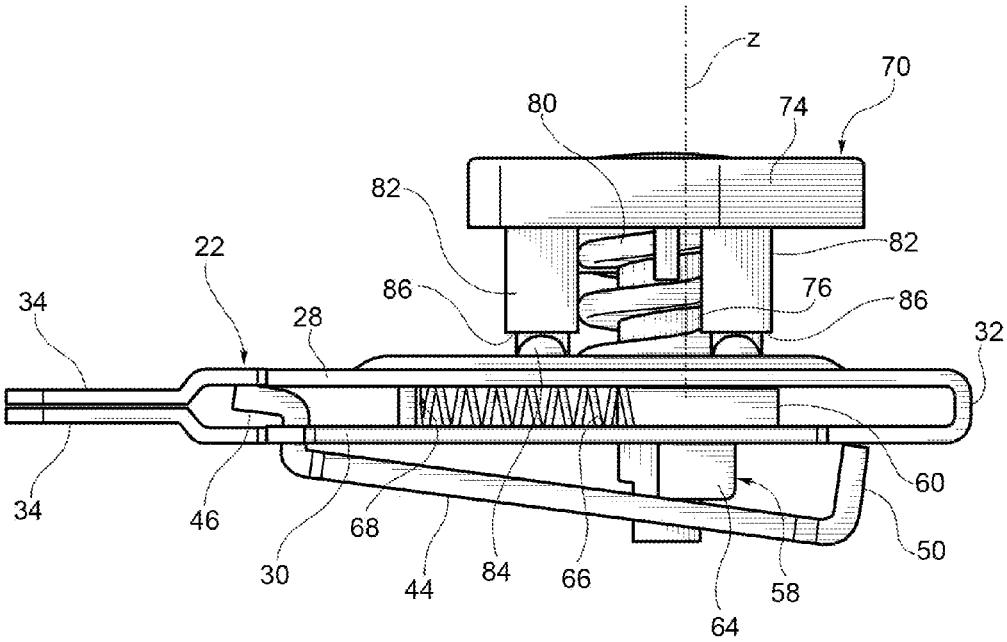
Figure 5:
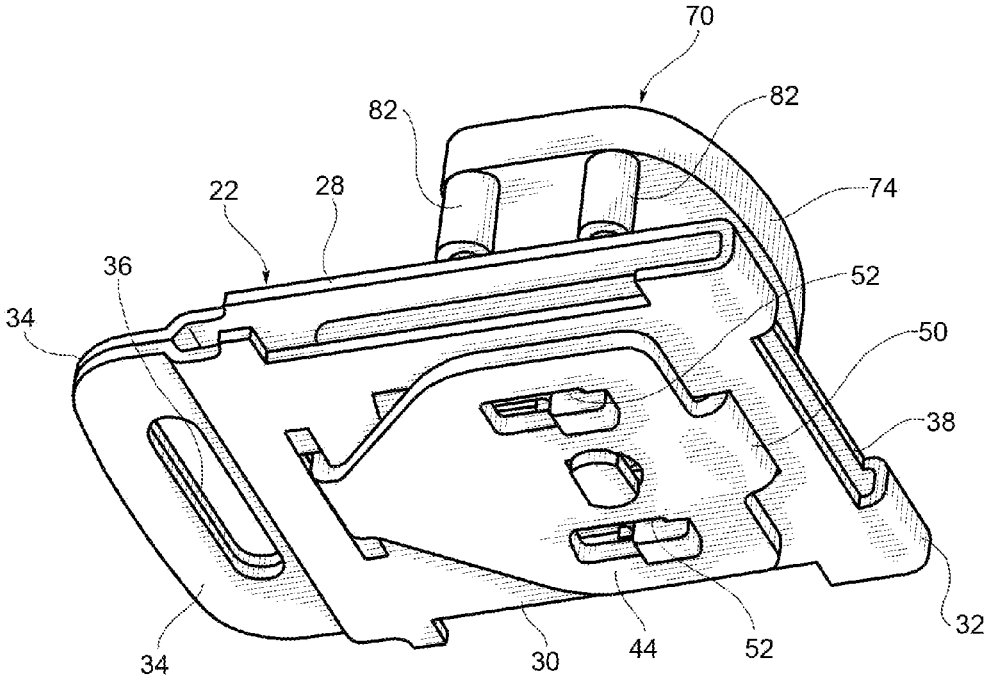
FIGS. 5 and 6 are a perspective view and a side elevational view, respectively, of the snap coupling mechanism and of the inner body of the buckle of the fastening device of FIGS. 1 and 2 in the closed position, i.e. in the lock position of the locking element of that mechanism.
Figure 6:
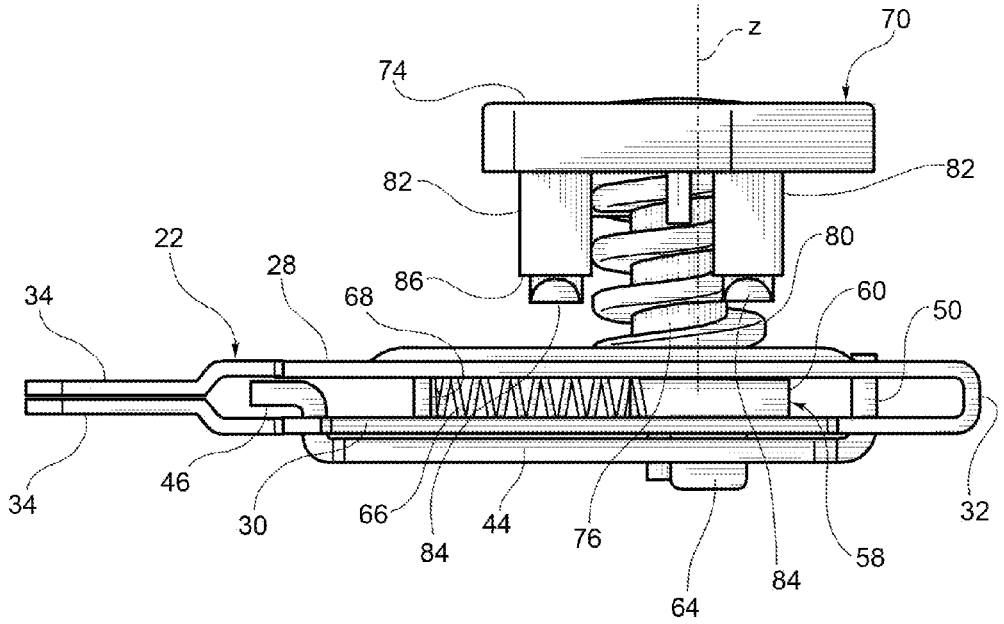
Figure 7:
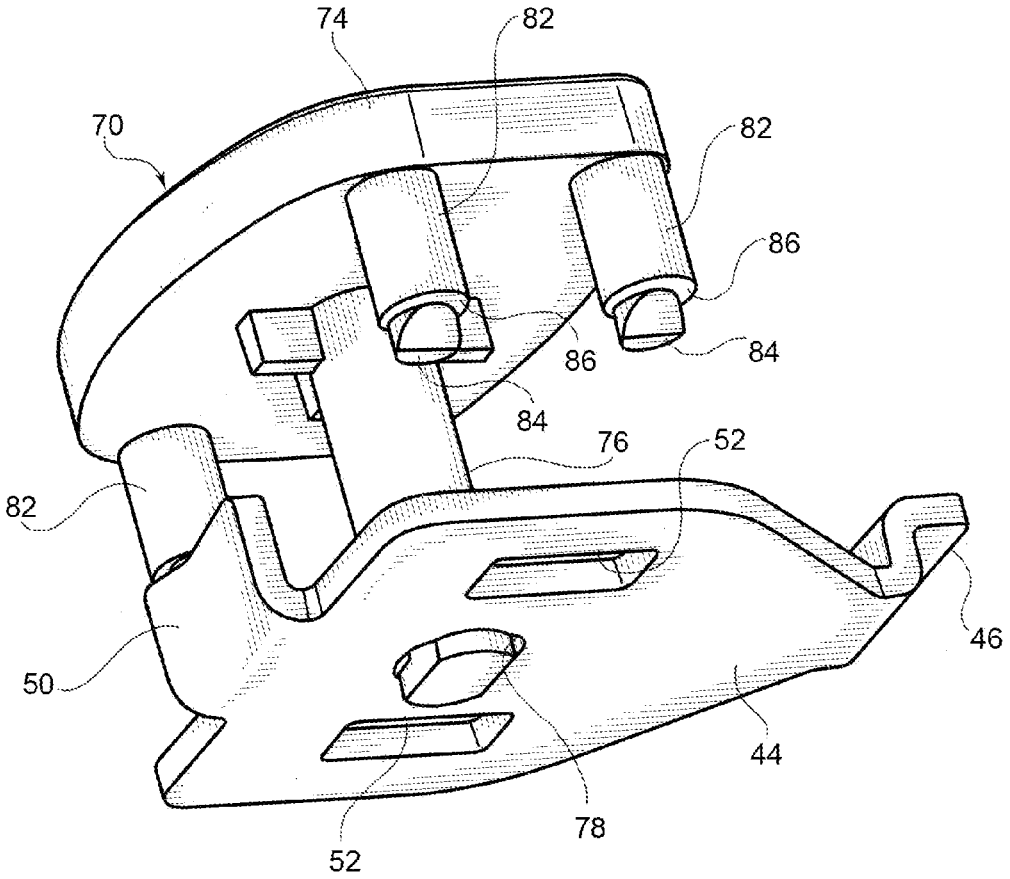
FIG. 7 is a perspective view of the assembly formed by the release button and by the locking element of the snap coupling mechanism of the buckle of the fastening device of FIGS. 1 and 2.

The snap coupling mechanism further comprises a release button 70 received in a cavity 72 provided in the upper half-shell 24 of the outer shell of the buckle 12 so as to be slidable along a direction z perpendicular to the plates 28 and 30 of the inner body 22 (i.e. along a vertical direction, according to the point of view of one looking at FIGS. 4 and 6). The release button 70 and the locking element 44 are therefore arranged on opposite sides of the inner body 22. The release button 70 is connected to the locking element 44 in such a manner that its movement along the direction z brings about a pivoting movement of the locking element 44 about the pivot axis y. More specifically, the release button 70 comprises an upper plate portion 74 (hereinafter simply referred to as plate), on which the user can apply a pressure with a finger, and a leg 76 which extends vertically downwards from the plate 74 (preferably from a middle point of the plate 74) and, in the mounted condition, passes through both the plates 28 and 30 of the inner body 22 and engages at its lower end, for instance by means of a bayonet coupling, in a slot 78 provided in the locking element 44 (FIG. 7). As shown in FIGS. 3 to 6, the release button 70 is normally kept, due to the resilient force applied by a spring 80, in a raised position. In this position, the locking element 44 is in contact with the lower plate 30 of the inner body 22 and is therefore in the lock position. If the release button 70 is pressed by the user against the resilient force applied by the spring 80, the locking element 44 is moved away from the lower plate 30 of the inner body 22 and pivots about the pivot axis y. By virtue of suitable travel limiting means, described in detail further on, the downward movement of the release button 70 is limited to a lower end-of-travel position (hereinafter simply referred to as lowered position) corresponding to the unlock position of the locking element 44. The lock position of the locking element 44, i.e. the position in which the tongues 14 are locked in the buckle 12, corresponds therefore to the raised position of the release button 70, whereas the unlock position of the locking element 44, i.e. the position in which the tongues 14 are no more engaged by the locking element 44 and can then be ejected from the buckle 12 by means of the sliders 58, corresponds to the lowered position of the release button 70. The spring 80 is preferably made as a cylindrical helical spring wound around the leg 76 of the release button 70 and rests at the one end (lower end) against the upper plate 28 of the inner body 22 and at the other end (upper end) against the plate 74 of the release button 70. The aforesaid travel limiting means, which are adapted to limit the downward movement of the release button 70 and hence define the lowered position thereof, are formed in the illustrated embodiment by four legs 82 which are shorter than the leg 76, extend also vertically downwards from the plate 74 of the release button 70 and have an outer diameter, or width, larger than the width of the longitudinal slits 40 in the upper plate 28 of the inner body 22. An extension 84 having a diameter (or width) smaller than the width of the longitudinal slits 40 and than the diameter (or width) of the remaining leg portion extends downwards from the free end of each of the four legs 82. Each leg 82 forms therefore, around the respective extension 84, an abutment surface 86 parallel to the upper plate 40 of the inner body 22. In this way, when the release button 44 is moved downwards from the raised position, the extensions 84 of the legs 82 enter the longitudinal slits 40 until the abutment surfaces 86 come into abutment against the upper plate 40 of the inner body 22, thereby preventing the release button 44 from moving further downwards.

By virtue of the configuration described above, the release button of the buckle of the fastening device of the present invention has two stable operating positions which are well separate from each other and can thus be easily and unambiguously identified by the user, namely a raised position corresponding to the fastened condition of the belts (tongues correctly inserted into the buckle and locked therein) and a lowered position corresponding to the unfastened condition of the belts (tongues not locked in the buckle). Therefore, as long as the tongues are not correctly inserted into the inner body of the buckle and engaged by the locking element, the locking element is kept by the sliders in the unlock position and the release button is thus kept in the lowered position. The user thus realizes, seeing that the release button is still lowered, that the tongues are not both correctly locked in the buckle.

Naturally, the principle of the invention remaining unchanged, the embodiments and the constructional details may vary widely from those described and illustrated purely by way of non-limiting example, without thereby departing from the scope of the invention as defined in the appended claims.

The buckle as described and illustrated in the present application is conceived to meet the US regulations, which provide for the possibility to insert only one tongue at a time into the inner body of the buckle. As is clear in the light of the preceding description, the insertion of only one tongue into the inner body of the buckle simply causes the locking element to pivot about a pivot axis directed along the direction of insertion x, but is not sufficient to cause the locking element to move from the unlock position into the lock position, and hence to move the release button from the lowered position into the raised position. The release button remains therefore in the lowered position, which warns the user of the unfastened condition of the belts. The buckle of the present invention can however be easily adapted also to the European regulations, which require the simultaneous insertion of both the tongues into the inner body of the buckle. For this purpose, it is in fact sufficient to use a locking element having two hinge tabs placed on opposite sides of the direction of insertion, instead of only one hinge tab placed in the middle, whereby the locking element is prevented from pivoting about an axis directed along the direction of insertion.

What is claimed is:

1. A buckle for a fastening device for three-branch restraint belts for car safety seats for children, comprising an inner body adapted to receive stem portions, provided with coupling teeth, of a pair of tongues to be attached to two of the three belt branches, and a snap coupling mechanism adapted to releasably connect the tongues to the inner body; wherein the inner body having a through opening through which the stem portions of the tongues are insertable along a direction of insertion;

the snap coupling mechanism comprises:

a locking element supported by the inner body to be pivotable about a first pivot axis perpendicular to the direction of insertion between a locked position, in which the locking element engages the tongues to keep the tongues restrained in the inner body, and an unlock position, in which the locking element disengages the tongues to make the tongues free to be ejected from or pulled out of the inner body;

a release button movable by a user along a direction perpendicular to the direction of insertion and to the first pivot axis between a raised position and a lowered position corresponding to the locked position and to the unlocked position of the locking element, respectively;

a first resilient member operatively associated with the release button to apply the release button a resilient force tending to keep the release button in the raised position;

at least one slider mounted in the inner body to be slidable parallel to the direction of insertion to oppose the insertion of the tongues into the inner body; and a second resilient member operatively associated to said at least one slider to apply on said at least one slider a resilient force directed in the opposite direction with respect to the direction of insertion of the tongues into the inner body and in the direction of ejection of the tongues from the inner body;

wherein at least one slider is configured to come, under the action of said second resilient member, between the inner body and the locking element, when the locking element is moved into the unlocked position to prevent the locking element from moving from the unlocked position to the locked position, and wherein the release button and the locking element are connected to each other in such a manner that when the release button is pressed and then moved into the lowered position, the locking element moves into the unlocked position, and wherein when the release button is released, and gets back into the raised position as a result of the resilient action applied on the release button by said first resilient member, the locking element is pulled by the release button to the locked position.

2. The buckle according to claim 1, wherein the locking element is supported by the inner body to pivot about a second pivot axis directed along the direction of insertion, to allow insertion of one tongue at a time into the inner body.

3. The buckle according to claim 1, wherein the locking element and the release button are arranged on opposite sides of the inner body.

4. The buckle according to claim 3, wherein the inner body includes an upper plate and a lower plate extending parallel to and spaced apart from each other, and a connecting portion connecting the upper plate and the lower plate to each other and which has said through opening.

5. The buckle according to claim 4, wherein the locking element is made as a shaped element, the locking element abutting against the outer face of the lower plate of the inner body when the locking element is in the locked position and being inclined to the lower plate of the inner body about said first pivot axis when the locking element is in the unlocked position.

6. The buckle according to claim 5, wherein the release button comprises a shaped upper portion and a leg which extends vertically downwards from the shaped upper portion and, passing through the upper plate and the lower plate of the inner body, engages at a bottom end with the locking element.

7. The buckle according to claim 1, further comprising a travel limiting device for limiting the downward movement of the release button to define said lowered position.

* * * * *